US008764074B2

(12) United States Patent
Ploskunak

(10) Patent No.: US 8,764,074 B2
(45) Date of Patent: Jul. 1, 2014

(54) DOOR CLAMP

(76) Inventor: J. Robert Ploskunak, Murrysville, PA (US)

( * ) Notice: Subject to any disclaimer, the term of this patent is extended or adjusted under 35 U.S.C. 154(b) by 544 days.

(21) Appl. No.: 13/083,437

(22) Filed: Apr. 8, 2011

(65) Prior Publication Data

US 2011/0187131 A1 Aug. 4, 2011

Related U.S. Application Data

(63) Continuation-in-part of application No. 12/370,722, filed on Feb. 13, 2009, now Pat. No. 8,251,412.

(51) Int. Cl.
*E05C 1/12* (2006.01)

(52) U.S. Cl.
USPC ..... 292/164; 292/DIG. 15; 292/288

(58) Field of Classification Search
USPC ..... 292/288, DIG. 15, 260, 256, 164
See application file for complete search history.

(56) References Cited

U.S. PATENT DOCUMENTS 3,843,984 A * 10/1974 Bagheri et al. ..... 470/8
3,896,698 A * 7/1975 Aylott ..... 411/548
4,330,146 A * 5/1982 Sessions, Jr. ..... 292/258

* cited by examiner

*Primary Examiner* — Mark Williams
(74) *Attorney, Agent, or Firm* — Richard W. James

(57) ABSTRACT

Apparatuses and methods for securing a door. The apparatuses include a door clamp having a stop, a base attached to the stop, a jamb bracket attached to the base, and a fastener coupled to the jamb bracket. In one embodiment, the apparatus includes first and second jamb brackets attached at a hinge, a handle attached coaxially with the hinge, first and second bases extending from the jamb brackets, and first and second stops attached to the bases.

12 Claims, 13 Drawing Sheets

DOOR CLAMP

CROSS-REFERENCE TO RELATED APPLICATIONS

The present application is a continuation-in-part of U.S. patent application Ser. No. 12/370,722, filed Feb. 13, 2009, which is incorporated herein in its entirety and is currently pending.

FIELD OF THE INVENTION

The present invention is concerned with securing a door. An embodiment of the invention secures a door against an intruder where the intruder can gain access to the doorknob or handle area on both sides of the door.

BACKGROUND OF THE INVENTION

In certain circumstances, it may be desirable to have a locking mechanism that locks a door from the inside—that is from the side toward which the door closes, as opposed to the side toward which the door swings open—where a conventional door lock is not available or can be unlocked from the outside, for example, by use of a key or by breaking a window and reaching through the window to turn the inner doorknob or a lock near the inner doorknob. Such a locking mechanism may, for example, be beneficial in a school classroom setting when there is a lockdown situation where a teacher is instructed to safeguard students in the classroom when there is a disruption or dangerous situation existing elsewhere in or around the school.

In a school classroom, doors typically swing out away from the classrooms and toward the hallway. Moreover, school classroom doors frequently have a locking mechanism that may be operated by key from the outside the classroom, but not from the inside the classroom. Such a door locking arrangement may be desirable to prevent access to the room when it is not to be occupied and to prevent a student or other person from entering the room and locking teachers, administration, or security out of the room. Such a school door locking arrangement may, however, be disadvantageous during, for example, a lockdown situation.

School classroom doors also generally have a window that extends to near the knob. That window could be broken permitting a person outside the door to reach through the window and turn the knob from the inside to circumvent a knob based lock or a lock positioned near the knob. Deadbolts and other locking mechanisms are typically not used in classroom door applications, again, to prevent anyone inside the room from locking the door, such as a student locking a teacher, administrator, or security officer out of the classroom. Thus a door, such as the typical classroom door described hereinabove, may not be suited for a situation where the door is desired to be secured from the inside, for example when a lockdown situation arises.

Accordingly, it may be desirable to have a locking or clamping mechanism that is separate from the door and may be applied to the door from the side on which the door closes to prevent the door from being opened by someone outside the door. Such a door clamp could be self-contained, portable, and able to be secured and accessed by a limited number of people.

Such a door clamp may be used at schools, offices, post offices, hospitals, or any facility where doors open outward and are without a secure built in locking mechanism on the inside. The jamb lock door clamp described herein may thus provide security in situations, including lockdowns, where intruders must be prevented from entering a room.

Certain embodiments of the present door clamping mechanism provide apparatuses and methods to prevent access to a room by preventing a person outside the room from unlocking a door from outside the door and from opening the door by either of its interior or exterior knobs.

SUMMARY OF THE INVENTION

Embodiments of the invention are directed to methods and apparatuses for securing doors.

In accordance with one embodiment, the jamb lock door clamp includes a stop, a base attached to the stop, a jamb bracket attached to the base, and a fastener coupled to the jamb bracket.

In accordance with one embodiment of the present invention, a method of securing a door using such a device is provided. The method includes positioning a stop portion of a clamp horizontally, sliding the stop portion of the clamp under a door and past a far side of the door moving the clamp to adjacent a door jamb, and placing a pin extending through the clamp into the door jamb.

In accordance with another embodiment, a jamb lock door clamp includes first and second jamb brackets attached at a hinge, a handle attached coaxially with the hinge, first and second bases extending from the jamb brackets, and first and second stops attached to the bases. The first and second jamb brackets in such an embodiment each have a first end and a second end, the hinge has an axis and is rotatably attached to the first end of the first jamb bracket to the first end of the second jamb bracket, the handle is attached coaxially with the hinge to at least one of the first jamb bracket, the second jamb bracket, and the hinge, the first base extends from the second end of the first jamb bracket, the second base extends from the second end of the second jamb bracket, the first stop is attached to the first base, and the second stop is attached to the second base.

In accordance with an embodiment of the present invention, a method of securing a door using such a device is provided. The method includes holding the double-door clamping device by the handle, thereby permitting the first jamb bracket and the second jamb bracket to rotate about the hinge and hang downward. The first and second bases of the double-door clamping device are placed on the floor at the base of the double-door near the place where the doors meet. The first and second stops and bases are then moved under the doors until the first and second stops extend beyond the outer surfaces of the double-doors. The handle is then moved toward the floor.

Accordingly, the present invention provides solutions to the shortcomings of prior door securing systems, apparatuses, and methods. Those of ordinary skill in the art will readily appreciate, therefore, that those and other details, features, and advantages of the present invention will become further apparent in the following detailed description of the preferred embodiments of the invention.

BRIEF DESCRIPTION OF THE DRAWINGS

The accompanying drawings, which are incorporated herein and constitute part of this specification, include one or more embodiments of the invention, and together with a general description given above and a detailed description given below, serve to disclose principles of embodiments of jamb lock door clamping devices and methods of securing a door.

DETAILED DESCRIPTION OF THE INVENTION

Jamb lock door clamping apparatuses and methods of securing a door are described herein. Reference will now be made to embodiments of those door clamping apparatuses and methods of securing a door, examples of which are illustrated in the accompanying drawings. Details, features, and advantages of the jamb lock door clamp will become further apparent in the following detailed description of embodiments thereof. It is to be understood that the figures and descriptions included herein illustrate and describe elements that are of particular relevance to jamb lock door clamping apparatuses and methods of securing a door while eliminating, for purposes of clarity, other elements found in typical door systems.

Any reference in the specification to "one embodiment," "a certain embodiment," or any other reference to an embodiment is intended to indicate that a particular feature, structure or characteristic described in connection with the embodiment is included in at least one embodiment and may be utilized in other embodiments as well. Moreover, the appearances of such terms in various places in the specification are not necessarily all referring to the same embodiment. References to "or" are furthermore intended as inclusive so "or" may indicate one or another of the ored terms or more than one ored term.

Figure 1:
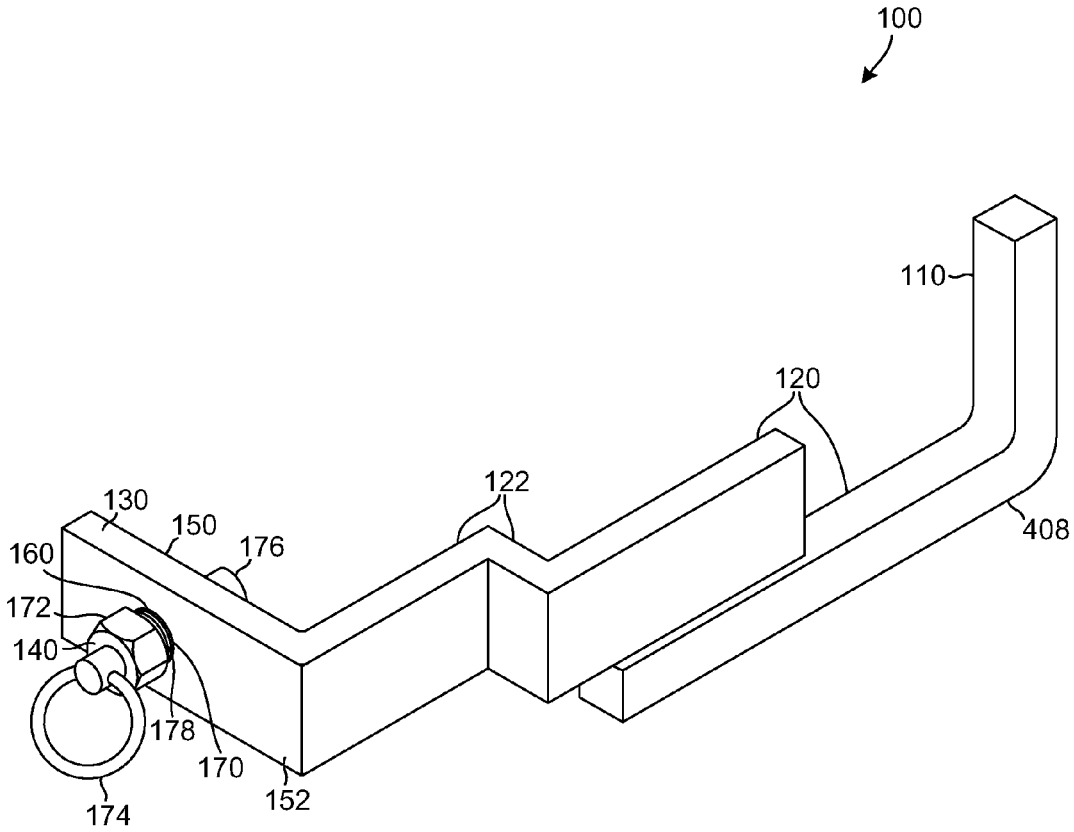
FIG. 1 illustrates an isometric view of an embodiment of a jamb lock door clamp.

FIG. 1 illustrates an isometric view of a jamb lock door clamp 100. The jamb lock door clamp 100 includes a stop 110, a base 120, a jamb bracket 130, and a fastener 140. The door clamp 100 also has an inner side 150 and an outer side 152.

The stop 110 depicted in FIG. 1 is arranged at a 90° or right angle to the base 120 such that the stop 110 may extend along or near an outer surface of a door while the base 120 is situated under the door. The jamb bracket 130 is also arranged at a 90° or right angle to the base 120 and perpendicular to the stop 110 such that the jamb bracket 130 may extend along an inner surface of a door jamb while the base 120 is situated under the door and the stop 110 extends along the door. Alternately, the stop 110 and the jamb bracket 130 may be configured in relation to the base 120 as desired to suit a desired door configuration.

The base 120 illustrated in FIG. 1 includes an angled portion 122 contoured to fit against certain doors. As will be seen in connection with door clamp 400 illustrated in FIG. 5, such an angled portion is optional.

A fastener orifice 160 may be created in the jamb bracket 130. The fastener orifice 160 may be a threaded hole such that a threaded portion 178 of a holding pin 170 may be positioned through the fastener orifice 160, as illustrated in FIG. 1. The holding pin 170 may furthermore extend through the fastener orifice 160 and extend past the inner side 150 of the jamb bracket 130.

Figure 1A:
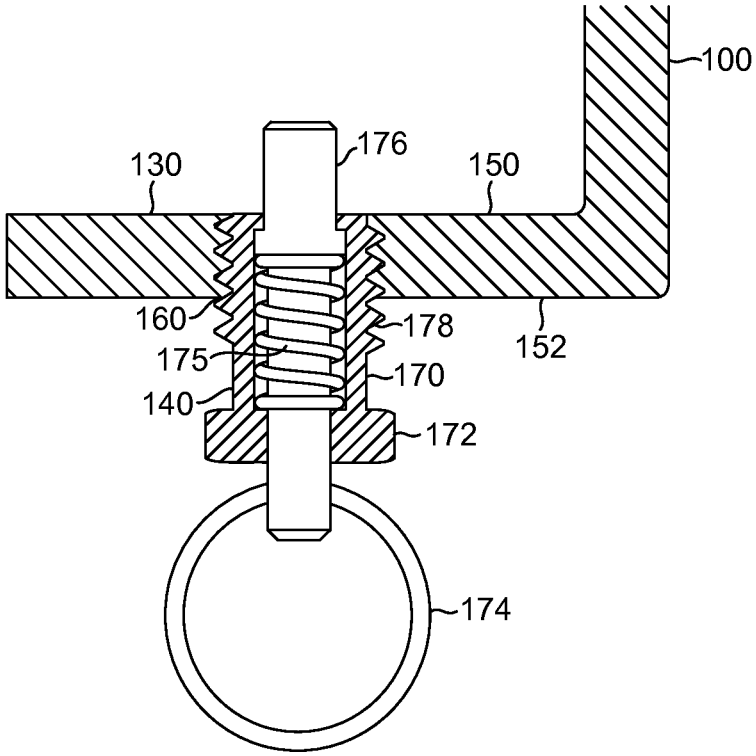
FIG. 1A illustrates a top cutaway view of a portion of the door clamp of FIG. 1 showing the inside of a holding pin threaded into the pin orifice of the door clamp.

FIG. 1A illustrates a top cutaway view of a portion of door clamp 100 showing the inside of holding pin 170. In embodiments, the holding pin 170 is a threaded pin with a plunger 176 of the pull-ring, lever, T-handle or other desired type disposed therein. That type of holding pin 170 includes a spring-biased plunger 176 that extends through the threaded portion 178 of the holding pin 170. In such an embodiment, the threaded portion 178 of the holding pin 170 may be threaded into the fastener orifice 160 but not through the inner side 150 of the door clamp 100. The spring-biased plunger 176 may then be pulled against the bias of the spring 175 so that the spring-biased plunger 176 does not extend through the inner side 150 of the door clamp 100 and, when the door clamp 100 is properly positioned, the spring-biased plunger 176 may be released so that the spring-loaded plunger 176 extends through the inner side 150 of the door clamp 100.

The holding pin 170 may have one or more portions formed for ease of turning the holding pin 170 and thereby threading the holding pin 170 through the fastener orifice 160. For example, as shown in FIG. 1, the threaded portion 178 of the holding pin 170 may include a hex head 172 of the type that is frequently turned using a wrench.

Also as shown in FIG. 1, the holding pin 170 may have one or more portions formed to facilitate pulling the spring-biased plunger 176 against the spring-bias, such as the ring 174.

Figure 2:
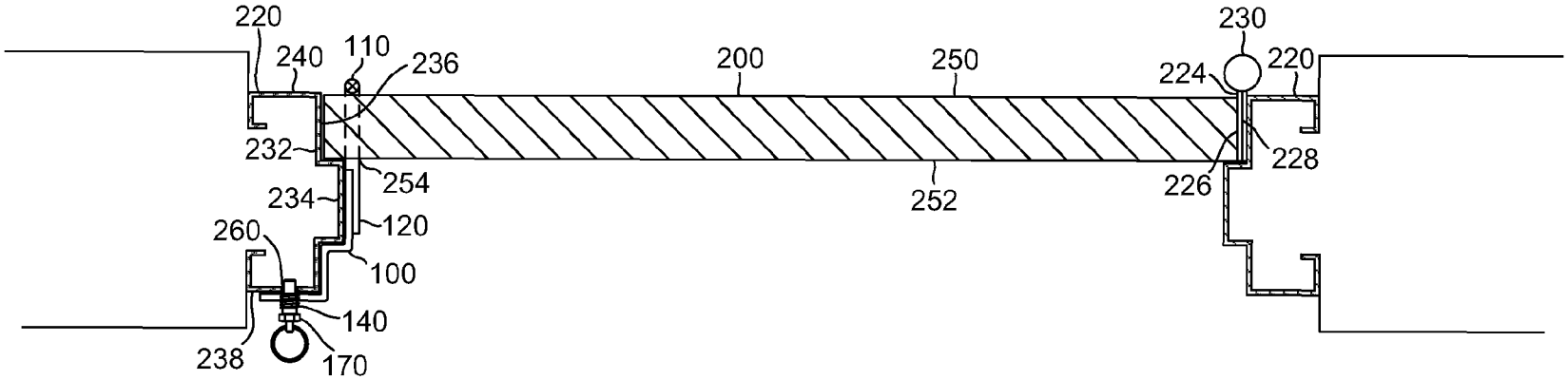
FIG. 2 illustrates a top view of an embodiment of a door and frame with the door clamp of FIG. 1 applied thereto.

FIG. 2 illustrates a top view of an embodiment of a door 200 and frame 220 with a jamb lock door clamp 100 affixed thereto. The door 200 is attached to the frame 220 by hinges 224. The door 200 may be attached by any desired number of hinges 224, from 2 to 4 or more. The hinges 224 typically include two halves, a door side hinge 226 and a frame side hinge 228, coupled by a hinge pin 230 such that the door side hinge 226 and the frame side hinge 228 rotate around the hinge pin 230, permitting the door 200 to swing open in one direction and closed in the opposite direction. The hinges 224 are commonly attached to the door 200 and the frame 220 by screws, but may be attached in any way desired.

The door 200 latches into a latch side jamb 232 portion of the frame 220. A strip 232 extends from the frame 220 or is formed in the frame 220 to stop the door 200 when the door 200 is closed. The door frame 220 further includes a facing surface 236 adjacent the door 200 when the door 200 is closed, an inner surface 238, and an outer surface 240.

The door 200 has an outer side 250 facing the direction in which the door swings open and an inner side 252 facing the direction toward which the door 200 swings closed. An edge 254 of the inner side 252 of the door 200 thus rests adjacent the strip 232 when the door is closed.

A fastener hole 260 may be created in the door frame 220 for positive engagement of the door clamp 100 to the door frame 220. The fastener hole 260 in the door frame 220 may be created in various ways. For example, the fastener hole 260 may be created by positioning the jamb lock door clamp 200 and marking the hole through the fastener orifice 160 with a scriber, pencil, or other marking instrument. Then the jamb lock door clamp 200 may be removed and a hole may be drilled or otherwise formed in the door frame 220 at the mark so that the holding pin 170 can extend into the door frame 220 when the jamb lock door clamp 100 is positioned in its locking position. It should be noted that the fastener hole 260 in the door frame 220 may be threaded, but need not necessarily be threaded to secure the jamb lock door clamp 100 in place by way of the holding pin 170 because movement of the jamb lock door clamp 100 lengthwise along the base 120 is limited by the stop 110 contacting the outer side 250 of the door 200.

Figure 3:
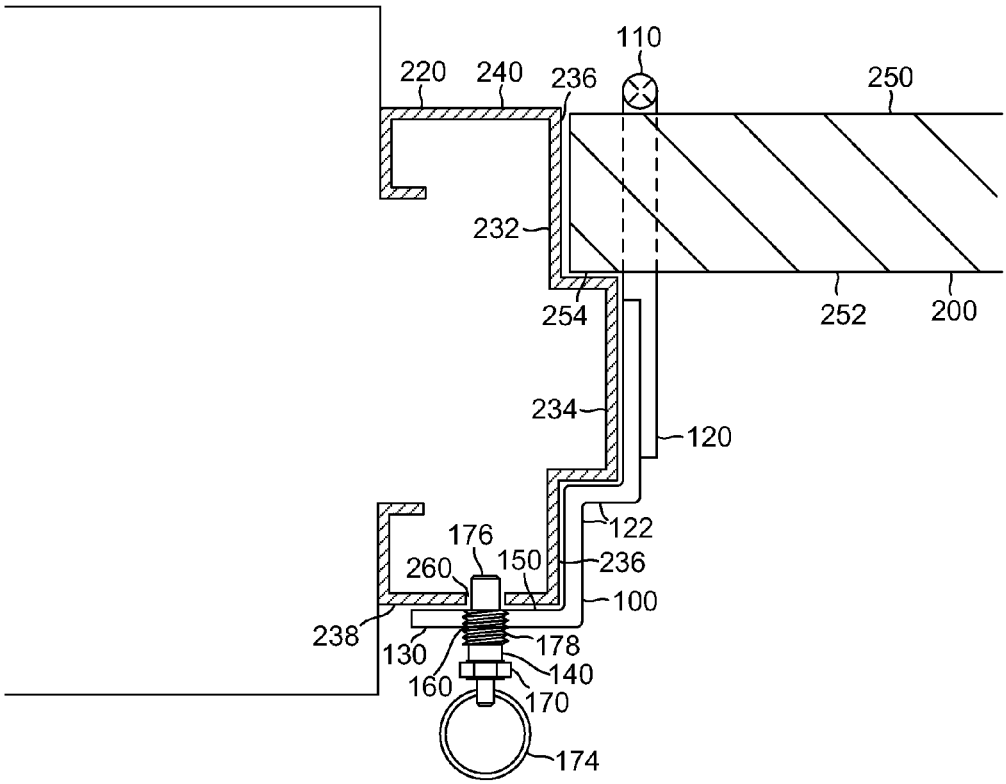
FIG. 3 illustrates an enlarged top view of a portion of the door and frame with the door clamp attached thereto, depicted in FIG. 2.

FIG. 3 is an enlarged view of a portion of the door 200 and frame 220 depicted in FIG. 2 having the jamb lock door clamp 100 affixed thereto. The door clamp 100 may be shaped as desired to fit any desired door. For example, the door clamp 100 depicted in FIGS. 1, 2, and 3 has a bend 122 in the base 120 to fit around the strip 234 attached to a door frame 220. In that embodiment, the bend 122 of the base 120 extends along the strip 234 and facing surface 236 of the frame 220. The jamb bracket 130 turns perpendicular to the base 120 to extend along the inner surface 238 of the door frame 220. In that embodiment, the holding pin 170 extends perpendicular to the inner side 252 and outer side 250 of the door 200 through the jamb bracket 130 and into the door frame 220. In that embodiment, the holding pin 170, when inserted into the fastener hole 260, prevents the jamb lock door clamp 100 from moving away from the door frame 220.

The jamb lock door clamp 100 may be used to secure a door, such as the door 200 illustrated in FIG. 2, quickly and easily. In an embodiment of door clamp 100 operation, the door clamp 100 depicted in FIG. 1 is positioned on the floor near the door 200. The door clamp 100 is positioned such that the stop 110 of the door clamp 100 is horizontal. The stop 110 is then slid under the door 200 and past the outer side 250 of the door 200. Once the stop 110 is extended past the outer side 250 of the door 200, the door clamp 100 is rotated 90° so that the stop 110 is vertical. The door clamp 100 is then moved to adjacent the door frame 220. As may be seen in FIG. 2, the stop 110 of the door clamp 100 may be positioned against the side of the door frame 220 opposite the hinges 224 that swings away from the door frame 220. The holding pin 170 may then be placed against or extended into the door frame 220.

As may be seen in FIG. 3, the holding pin 170 may be placed through the door clamp 100 as desired, including by threading a portion 178 of the holding pin 170 into the door clamp 100. The holding pin 170 may furthermore extend through the door clamp 100 into the door frame 220 by pulling the spring-biased plunger 176 of the holding pin 170 until the spring-biased plunger 176 of the holding pin 170 is nearly flush with the inner surface 150 of the door clamp 100, moving the door clamp 100 toward or against the door frame 220 so that the holding pin 170 is aligned with the fastener hole 260 in the door frame 220, and releasing the spring biased plunger 176 of the holding pin 170 such that the spring biased plunger 176 extends into the fastener hole 260 in the door frame 220.

Thus, the threaded portion 178 of the holding pin 170 may be screwed into the door clamp 100 by hand, wrench or as desired, and remain there when the door clamp 100 is not in use. Then, when the door clamp 100 is used, the person positioning the door clamp 100 may pull the spring-biased plunger 176 using the ring 174 or otherwise as desired, until the holding pin 170 is in contact with the door frame 220. The user may then release the spring-biased plunger 176 and move the door clamp 100 until the holding pin 170 is aligned with the fastener hole 260 in the door frame 220 and the spring-biased plunger 176 extends into the fastener hole 260 in the door frame 220.

Figure 4:
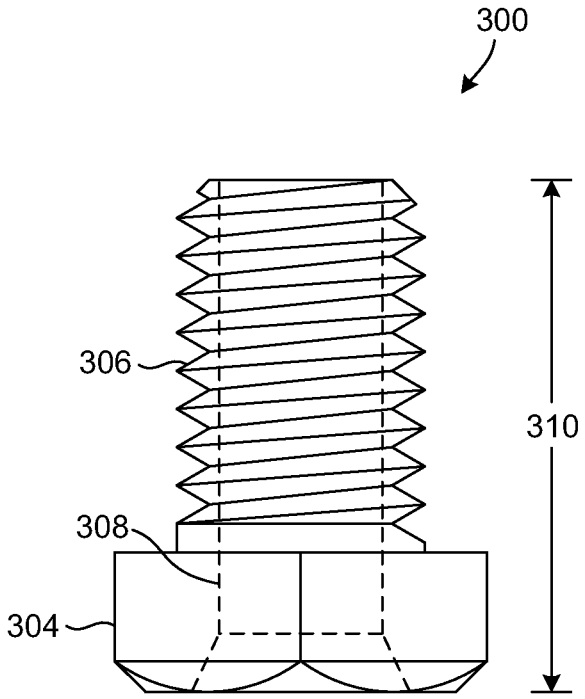
FIG. 4 illustrates a side view of a hollow bolt guide.

FIG. 4 illustrates a hollow guide 300 that may be used when creating the fastener hole 260 in the door frame 220. The hollow guide 300 may be a standard machine threaded bolt, axially bored through the hollow guide 300. Thus the hollow guide 300 depicted in FIG. 4 is, bored longitudinally through the center and for the length of the hollow guide 300. The hollow guide 300 embodiment depicted in FIG. 4 includes a hex head 304, an externally threaded shaft 306, and an axial bore 308 through the longitudinal length 310 of the hollow guide 300.

In operation, the hollow guide 300 may be threaded into the fastener orifice 160 of the jamb lock door clamp 100. The door clamp 100 may then be positioned against a door 200 and door frame 220 and the hollow guide 300 may be tightened against the door frame 220. Next, a fastener hole 260 may be bored into the door frame 220 through the hollow guide 300 by any means desired. In an embodiment, the fastener hole 260 is drilled into the door frame 220 using a drill having a bit that extends through the hollow guide 300. After the fastener hole 260 has been formed in the door frame 220, the hollow guide 300 may be removed from the door clamp 100 and the holding pin 170 may be threaded into the door clamp 100 in place of the hollow guide 300.

Figure 5:
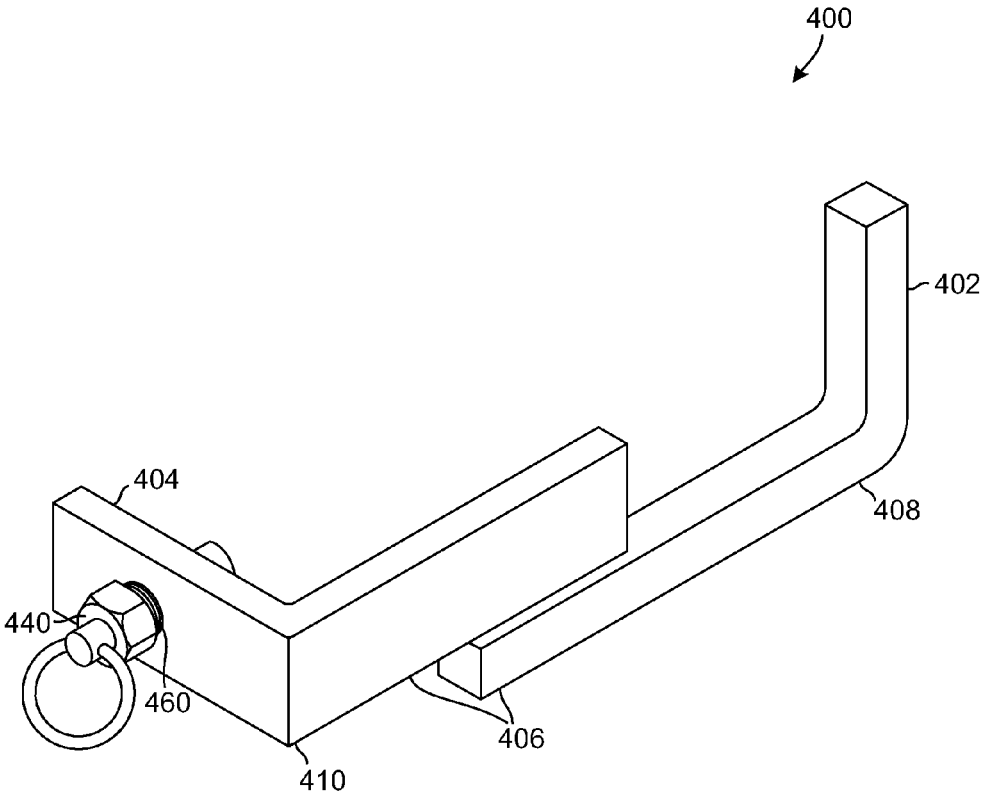
FIG. 5 illustrates an isometric view of another embodiment of a jamb lock door clamp.

FIG. 5 illustrates an embodiment of the jamb lock door clamp 400 in the form of a hooked bracket. The hooked bracket type door clamp 400 includes a door hook portion 402 that slips under a door 200 and is turned to be positioned adjacent the outer side 250 of the door 200. The hooked bracket type door clamp 400 illustrated in FIG. 5 also includes a frame hook portion 404 that is placed adjacent the door frame 220. The door hook portion 402 extends from a first end 408 of a central portion 406 and the frame hook portion 404 extends from an opposite second end 410 of the central portion 406 in the embodiment depicted in FIG. 5. A fastener 440, such as the holding pin 170 described hereinabove, may be placed through an orifice 460 in the jamb lock door clamp 400. In the embodiment illustrated in FIG. 5, the orifice 460 is located in the frame hook portion 404 of the jamb lock door clamp 400 such that the fastener 440 can extend into the inner surface 238 of the door frame 220. It should be noted that the frame hook portion 404 may not be necessary in certain embodiments where the door clamp 400 may be pinned, attached, or otherwise secured to the facing surface 236 of the door frame 220 without turning along the inner surface 238 of the door frame 220. Thus, the orifice 460 may be located in the jamb lock door clamp 400 such that the fastener 440 extends into the inner surface 238 of the door frame 220.

An embodiment of a method of installing the jamb lock door clamp 400 includes threading the hollow guide 300 depicted in FIG. 4 into the jamb lock door clamp 400. The jamb lock door clamp 400 is then positioned around the door 200 and against the door frame 220 as it is to be used. A fastener hole 260 is then created in the door frame 220 so that, when the hollow guide 300 is replaced with the fastener 440, the fastener 440 can extend through the jamb lock door clamp 400 into a fastener hole 260 in the door frame 220, thereby securing the jamb lock door clamp 400 in its locking position.

Figure 6:
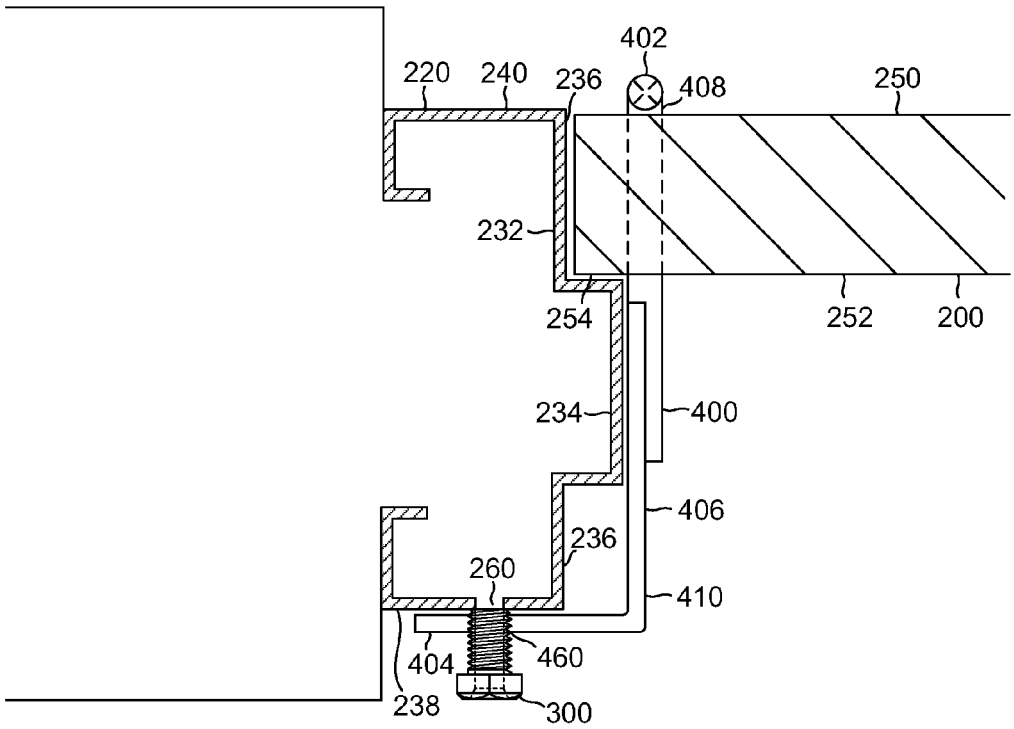
FIG. 6 illustrates a top view of the door clamp of FIG. 5 positioned adjacent the door and frame of FIG. 2 with the hollow guide of FIG. 4 positioned for forming a fastener hole.

FIG. 6 illustrates a top view of the door clamp 400 positioned adjacent a door 200 and frame 220 with the hollow guide 300 positioned for forming a fastener hole 260 in the door frame 220. As may be seen, the door clamp 400 is positioned adjacent the door frame 220 and the hollow guide 300 is threaded through the orifice 460 and tightened against the inner surface 238 of the door frame 220 to hold the door clamp 400 in place. The fastener hole 260 may then be formed through the hollow guide 300 by, for example, drilling through the hollow guide 300 into the door frame 220.

Figure 7:
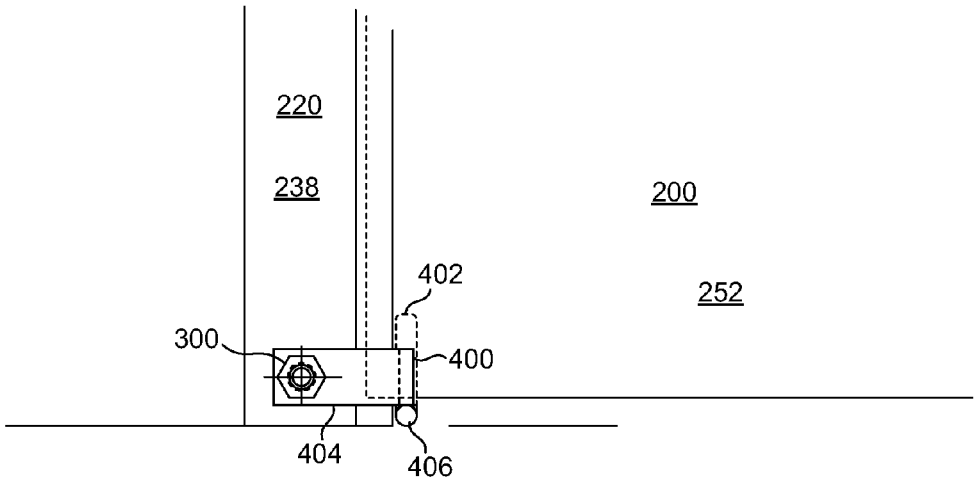
FIG. 7 illustrates a side view of a portion of the inner side of the door and frame of FIG. 2 with the door clamp of FIG. 5 and hollow guide of FIG. 4.

FIG. 7 illustrates a view of a portion of the inner side of the door 252 and frame 220 illustrated in FIG. 6. A jamb lock door clamp 400 is positioned adjacent the door 200 and frame 220 with the hollow guide 300 holding the door clamp 400 in place for drilling the fastener hole 260.

Figure 8:
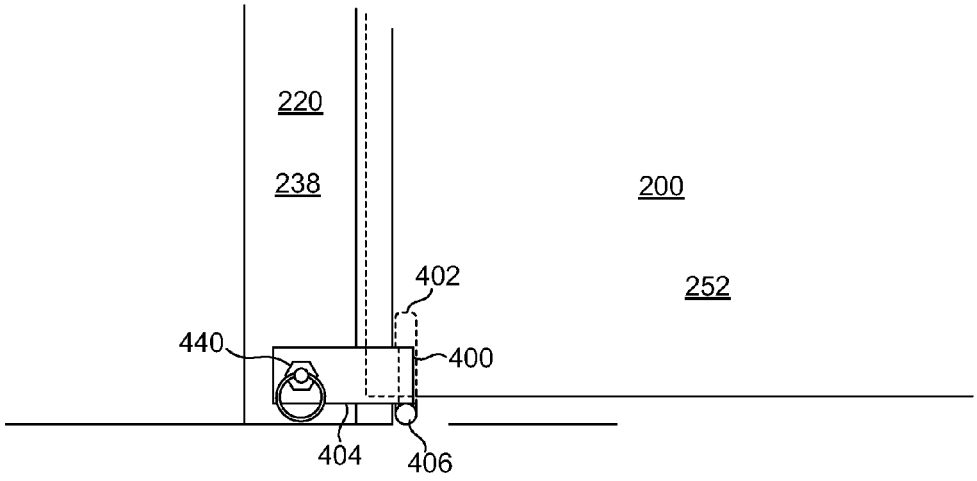
FIG. 8 illustrates the portion of the inner side of the door and frame of FIG. 7 with the door clamp of FIG. 5 and a holding pin threaded into the pin orifice of the door clamp

FIG. 8 illustrates the portion of the inner side of the door 252 illustrated in FIG. 6 with the hollow guide 300 removed from the door clamp 400 and the fastener 440 threaded into the fastener orifice 160 of the door clamp 400 in place of the hollow guide 300. As may be seen in FIG. 8, the door hook portion 402 of the door clamp 400 is positioned adjacent the outer side 250 of the door 200 and the frame hook portion 404 is fastened to the door frame 220 by the fastener 440.

Whether including or not including the frame hook portion 404, the door clamp 400 can be attached to a door 200 and frame 220 by hand in seconds without tools or keys and is independent of a doorknob or handle assembly. The jamb lock door clamp 400 can furthermore be put in place and removed from inside a room without opening the door 200.

When operating the embodiment of the jamb lock door clamp 400 illustrated in FIG. 5, a user may rotate the jamb lock door clamp 400 such that the door hook portion 402 extends parallel to the floor and the perpendicular frame hook portion 404 extends upward from the floor. The jamb lock door clamp 400 may then be slid under the door 200 and rotated so that the door hook portion 402 extends up along the outer side 250 of the door 200 and the perpendicular frame hook portion 404 of the jamb lock door clamp 400 extends along the inner side 238 of the frame 220. The fastener 440 may then be placed through the jamb lock door clamp 400 such that the fastener 440 extends into the door frame 220.

The jamb lock door clamp 400, when placed in its locking position, thus extends under the door 200, clamping the outer side 250 of the door 200 against the door frame 220 inside the room. When positioned such, the jamb lock door clamp 400 secures a door 200 closed against the door frame 220. When securing the door 200, the door hook portion 402 extends along the outer side 250 of the door 200, the central portion 400 extends under the door 200, the frame hook portion 404 extends along the door frame 220 and the fastener 440 extends through the jamb lock door clamp 200 into the door frame 220.

Figure 9:
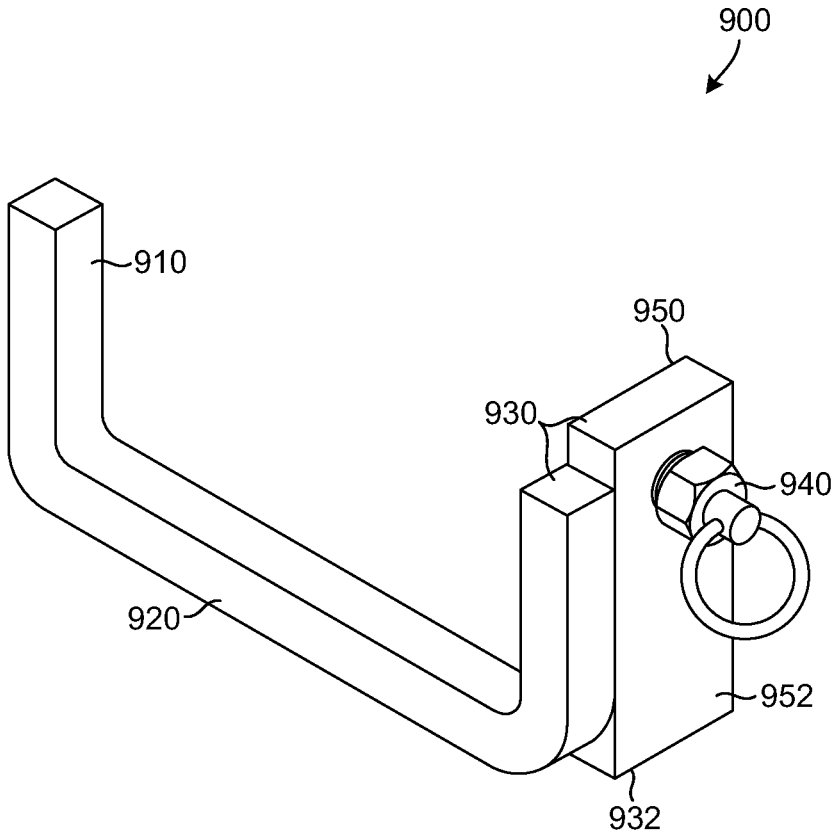
FIG. 9 illustrates an isometric view of an embodiment of a door clamping apparatus that may be used on a door that is to be prevented from swinging into a room.

FIG. 9 illustrates one embodiment of a door clamping apparatus 900 that may be used in an application where a door is to be prevented from swinging into a room. The door clamping apparatus 900 includes a jamb bracket 910, a base 920, a stop 930 having a stop extension, and a fastener 940. The door clamping apparatus 900 also has an inner side 950 and an outer side 952.

Figure 10:
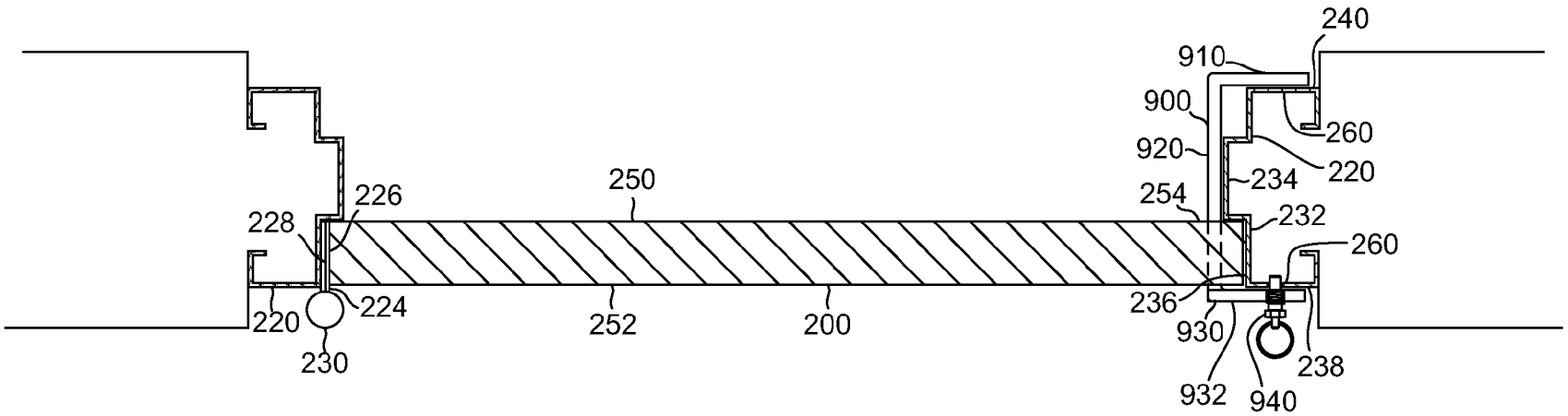
FIG. 10 illustrates a top view of the door clamping apparatus of FIG. 9 affixed to an inward swinging door.

FIG. 10 illustrates a top view of the door clamping apparatus 900 of FIG. 9 affixed to an inward swinging door 200. The door clamping apparatus 900 is affixed to the door 200 and frame 220, wherein the door 200 is attached to the frame 220 by hinges 224 having two halves, a door side hinge 226 and a frame side hinge 228, coupled by a hinge pin 230 such that the door side hinge 226 and the frame side hinge 228 rotate around the hinge pin 230, permitting the door 200 to swing open in a first direction and closed in a second, opposite direction.

The door 200 latches into a latch side jamb 232 portion of the frame 220. A strip 232 extends from the frame 220 or is formed in the frame 220 to stop the door 200 when the door 200 is closed. The door frame 220 further includes a facing surface 236 adjacent the door 200 when the door 200 is closed, an inner surface 238, and an outer surface 240.

The door 200 has an outer side 250 facing the direction in which the door swings closed and an inner side 252 facing the direction toward which the door 200 swings open. An edge 254 of the outer side 250 of the door 200 thus rests adjacent the strip 232 when the door is closed.

A fastener hole 260 may be created in the door frame 220 for positive engagement of the door clamping apparatus 900 to the door frame 220. The fastener hole 260 in the door frame 220 may be created in various ways, as described herein.

The fastener 940 is optional and may extend through the stop 930 or stop extension 932 to secure the door clamping apparatus 900 to the door frame 220 or door 200. Where the fastener hole 260 has been created, the fastener 940 may be inserted into the fastener hole 260 in any way desired, including placing a pin type fastener 940 through the stop 930 or stop extension 932 into the fastener hole 260 or by use of a holding pin 170, which engages the fastener hole 260 by releasing a spring-biased plunger 176, as described herein.

The stop 930 and jamb bracket 910 of this embodiment are arranged approximately in parallel and the stop 930 includes the stop extension 932, which extends up along the inner side 252 of the door 200 when the door clamping apparatus 900 is operably positioned under the door 200. Thus, when the stop 930 is placed along the outer surface 240 of the in-swinging door frame 220 with the base 920 extending under the door 220 and the stop extension 932 placed along the inner side 252 of the door 200, the door 200 is held against the frame 220 by the door clamping apparatus 900 and thereby prevented from opening.

Figure 11:
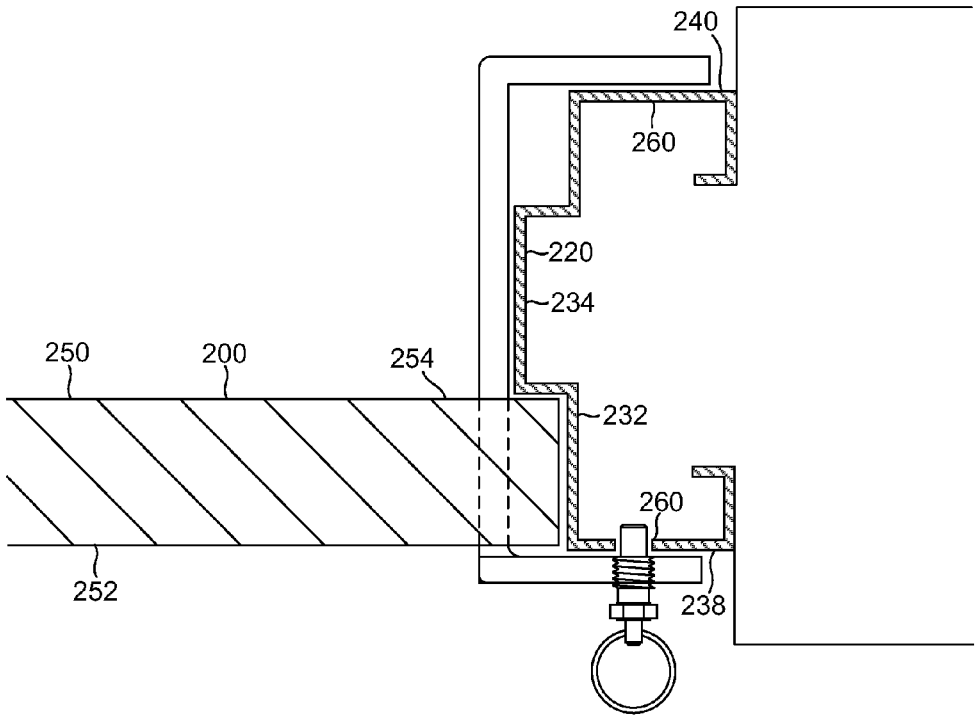
FIG. 11 illustrates an enlarged view of the door clamping apparatus of FIG. 9 affixed to the inward swinging door illustrated in FIG. 10.

FIG. 11 illustrates a partial view of the door clamping apparatus 900 illustrated in FIG. 9 holding an inward swinging door 200 against a door frame 220. In that embodiment, a plunger type fastener 940 is used to affix the door clamping apparatus 900 to the frame 220.

When operating the embodiment of the door clamping apparatus 900 in an application where the door 200 is to be prevented from swinging into a room, a user may set the door clamping apparatus 900 on the floor such that the jamb bracket 910 is lying on the floor and the stop extension 932 extends upward from the floor. The door clamping apparatus 900 may then be slid under the door 200, jamb bracket 910 first, until the stop 930 or stop extension 932 is adjacent to the door 200. The base 920 may then be moved adjacent to or against the door frame 220. In that way, the base 920 may be adjacent or against the strip 234 of the inward swinging door frame, the jamb bracket 910 may be adjacent or against the outer surface 240 of the in-swinging door frame 220, the stop 930 may be adjacent or against the inner surface 238 of the inward swinging door frame 220, and the stop extension 932 may be adjacent or against the inner side 252 of the door 200. The fastener 940 may then be placed through the door clamping apparatus 900 such that the fastener 940 extends into the door frame 220, for example passing through the inner surface 238 of the door frame 220.

FIG. 11 illustrates an enlarged top view of a portion of the door 200 and frame 220 depicted in FIG. 10 with the door clamping apparatus 900 operably coupled thereto. As may be seen with reference to FIG. 11, when placed in its locking position, the door clamping apparatus 900 thus extends under the door 200, clamping the inner side 252 of the door 200 against the outer surface 240 of the door frame 220. When positioned such, the door clamping apparatus 900 secures the door 200 closed against the door frame 220. When securing the door 200 in this embodiment, the jamb bracket 910 extends along the outer surface 240 of the door frame 220, the base 920 extends under the door 200 along the door frame 220, possibly along the strip 234, the stop 930 extends along the facing surface 236 of the door frame 220, the jamb bracket extension 932 extends along the inner surface 252 of the door 200, and the fastener 440 extends through the door clamping apparatus 900, possibly the stop 930, into the door frame 220, possibly the inner surface 238 of the door frame 220.

Figure 12:
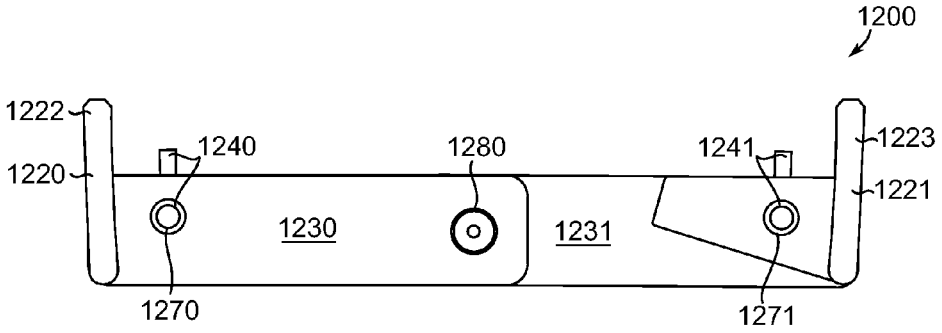
FIG. 12 illustrates a door side view of an embodiment of a door clamping device for use on double-doors.
Figure 13:
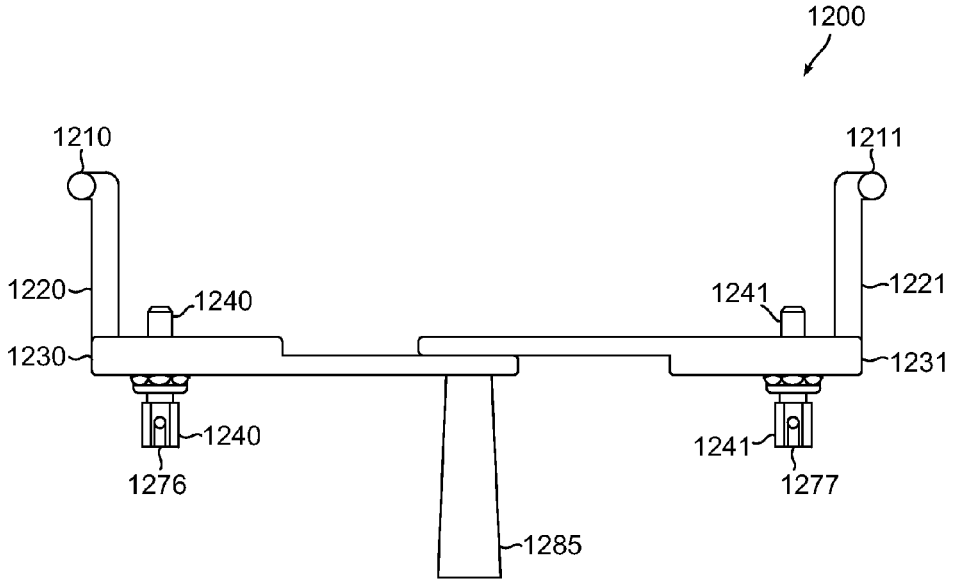
FIG. 13 illustrates a top view of the door clamping device of FIG. 12.
Figure 15:
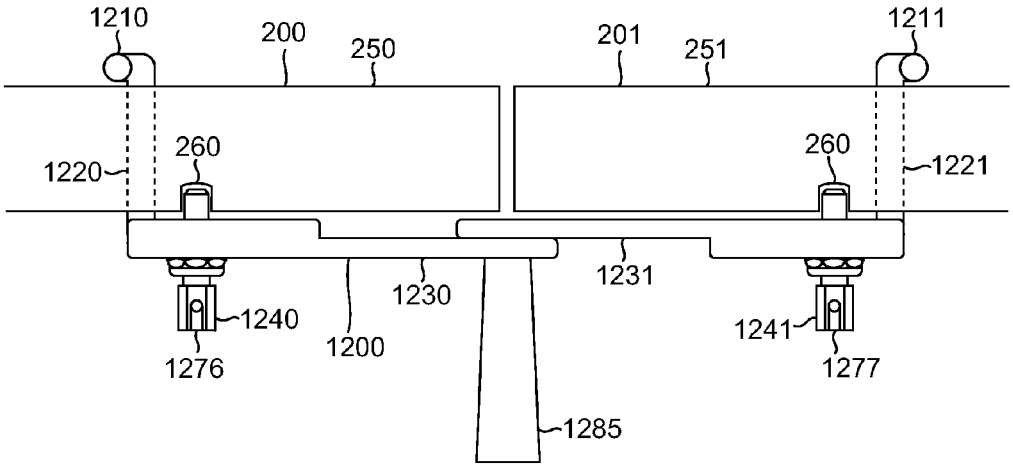
FIG. 15 depicts the door clamping device of FIGS. 12-14 affixed to double-doors.

FIG. 12 illustrates a door side view of an embodiment of a door clamping device 1200 for use on double-doors 200 and 201, as illustrated in FIG. 15 and FIG. 13 illustrates a top view of the door clamping device 1200 of FIG. 12. The double-door clamping device 1200 includes a first stop 1210, a second stop 1211, a first base 1220 and a second base 1221, a first jamb bracket 1230 and a second jamb bracket 1231, a hinge 1280, a handle 1285, a first fastener 1240, and a second fastener 1241. The first and second bases 1220 and 1221 extend from the first and second jamb brackets 1230 and 1231 toward the viewer in FIG. 12. The first and second stops 1210 and 1211 turn up from the first and second bases 1220 and 1221, respectively, as viewed in FIG. 12. In that way the first and second jamb brackets 1230 and 1231 may be placed adjacent the double-doors 200 and 201 on the side from which the double-doors are being secured, while the first and second stops 1210 and 1211 turn up along the side of the double-doors 200 and 201 opposite the side from which the double-doors are being secured in use, as may be seen in FIG. 15.

FIG. 13 illustrates a top view of the embodiment of the door clamping device 1200 for use on double-doors illustrated in FIG. 12. As may be seen, the handle 1285 of this embodiment is concentric with the hinge 1280 such that when the handle 1285 is grasped and the door clamping device 1200 is lifted by the handle 1285 with the handle 1285 in a substantially horizontal orientation, the first and second jamb brackets 1230 and 1231 rotate about the hinge 1280 and the first and second bases 1220 and 1221 move toward one another, as is illustrated in FIG. 14.

FIG. 13 further illustrates that the first and second bases 1220 and 1221 extend from the first and second jamb brackets 1230 and 1231 and that the first and second stops 1210 and 1211 turn from the first and second bases 1220 and 1221 opposite from the first and second jamb brackets 1230 and 1231. FIG. 13 also illustrates fasteners or holding pins 1240 and 1241 in one embodiment in which the holding pins 1240 and 1241 include spring-biased plungers 1276 and 1277, respectively, (which may be similar to the spring-biased plunger 176 illustrated in FIG. 5) that have plungers that may be rotated when pulled to lock the plungers in an unextended position. FIG. 14 illustrates the double-door clamping device 1200 in a folded configuration. As may be seen with reference to FIG. 13, the first jamb bracket 1230 and the second jamb bracket 1231 rotate about the hinge 1280 such that the first base 1220 and the second base 1221 are approximately aligned. In such a folded configuration, with the handle held substantially horizontal and the first base 1220 and second base 1221 hanging so that they extend out from the first jamb bracket 1230 and the second jamb bracket 1231, respectively, parallel with the floor and the first stop 1210 and second stop 1211 extend perpendicular to the first jamb bracket 1230 and the second jamb bracket 1231, respectively, also parallel with the floor, the first stop 1210 and second stop 1211 and the first base 1220 and the second base 1221 may be slid under double-doors such that the first and second bases 1220 and 1221 extend under the door and the first and second stops 1210 and 1211 are disposed beyond outer surfaces 250 and 251 of double-doors 200 and 201. The handle 1285 may then be lowered so that the first and second jamb brackets 1230 and 1231 rotate about the hinge 1280. When the handle 1285 is lowered and the first and second jamb brackets 1230 and 1231 rotate about the hinge 1280, the first and second bases 1220 and 1221 move apart, possibly sliding along the floor, and the first and second stops 1210 and 1211 extend up along the outer surfaces 250 and 251 of the double-doors 200 and 201 and may extend substantially vertically, as is illustrated in FIG. 15. The first and second jamb brackets 1230 and 1231 may furthermore extend up along interior surfaces 252 and 253 of the double-doors 200 and 201.

Figure 14:
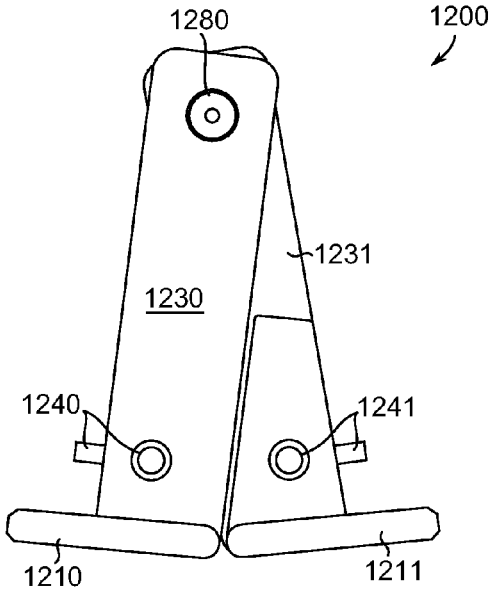
FIG. 14 illustrates a door side view of the door clamping device of FIGS. 12 and 13 in a folded configuration.

As illustrated in FIGS. 13 and 14, the first jamb bracket 1230, the second jamb bracket 1231, or both jamb brackets 1230 and 1231 may be shaped such that the jamb brackets 1230 and 1231 engage one another when they rotate to the folded orientation illustrated in FIG. 14 or, alternately, the first and second bases 1220 and 1221 may come into contact with one another to terminate rotation into the folded orientation.

Set-up of the double-door clamping device 1200 may be performed by an installer standing on the side of the double-doors that is desired to be secured. The installer may lift the double-door clamping device 1200 by the handle 1285, thereby permitting the first jamb bracket 1230 and the second jamb bracket 1231 to rotate about the hinge 1280 and hang downward in its folded orientation, as illustrated in FIG. 14. With the double-door clamping device 1200 in the folded orientation and the handle 1285 in hand, the first and second bases 1220 and 1221 of the double-door clamping device 1200 may be placed on the floor at the base of the double-door near the place where the doors 200 and 201 meet. Next the stop 1210 and the second stop 1211, as well as the first and second bases 1220 and 1221 may be slid through the space under the doors such that the first base 1220 and the second base 1221 are disposed under the double-doors 200 and 201 and the first stop 1210 and the second stop 1211 extend beyond the outer surfaces 250 and 251 of the double-doors 200 and 201. The double-door clamping device 1200 may be positioned such that its center is near the vertical line formed where the double-doors meet. The installer can then push down on the handle 1285, thereby moving the handle toward the floor. The motion of moving the handle 1285 toward the floor causes the first jamb bracket 1230 and the second jamb bracket 1231 to rotate about the hinge 1280 such that the first jamb bracket 1230 and the second jamb bracket 1231 extend out to opposite sides of the hinge 1280 along the floor and the first stop 1210 and the second stop 1211 extend up along the outer surfaces 250 and 251 of the double-doors 200 and 201 from the side of the double-doors 200 and 201 that is to be secured.

When the double-door clamping device 1200 is positioned to secure both double-doors 200 and 201, the installer may create fastener holes 260 in the doors 200 and 201 through the fastener orifices 1270 and 1271 so that, in actual use, the double-door clamping device 1200 may be secured to the doors 200 and 201 by holding pins 1240 and 1241 placed through the fastener orifices 1270 and 1271 into the fastener holes 260 created in the doors 200 and 201. The fastener holes 260 in the doors 200 and 201 may be created in any way desired, including use of the hollow guide 300 as discussed herein.

After the fastener holes 260 have been created in the doors 200 and 201, the holding pins 1240 and 1241 may be placed in the fastener orifices 1270 and 1271 to ready the double-door clamping device 1200 for use.

Use of the double-door clamping device 1200 to secure double-doors 200 and 201 is much as described in connection with set-up of the double-door clamping device 1200, with the exception that the holding pins 1240 and 1241 are placed in the previously created fastener holes 260 of the doors 200 and 201 when the double-door clamping device 1200 is positioned with the fastener orifices 1270 and 1271 aligned with the fastener holes 260.

The holding pins 1240 and 1241 may be any type of pin desired including those employing a spring-biased plunger or any other type discussed herein or available. The spring-biased plunger type pins may be advantageous in that they can spring into the fastener holes 260 when the double-door clamping device 1200 is properly aligned, thereby simplifying installation in what might be a tense circumstance. Thus, installation of the double-door clamping device 1200 may be completed by holding the double-door clamping device 1200 by the handle 1285 such that the first base 1220 and a second base 1221 hang downward, sliding the first base 1220 and the second base 1221, as well as the first stop 1210 and the second stop 1211 under the double-door, moving the handle 1285 downward to rest on the floor, and sliding the double-door clamping device 1200 along the interior surfaces 252 and 253 of the double-doors 200 and 201 until the retractable plunger pins 1240 and 1241 are released into the fastener holes 260.

To remove the double-door clamping device 1200, the holding pins 1240 and 1241 can be removed from the fastener holes 260 from the secured side of the doors 200 and 201. Where spring-biased retractable plunger pins 1240 and 1241 are used, the holding pins 1240 and 1241 may be removed from the fastener holes 260 by pulling the fastener pins 1240 and 1241 against the spring bias. In an embodiment, spring-biased retractable plunger pins 1240 and 1241 are rotatable and lock into a retracted position when rotated to a first position, while springing out when rotated into a second position. Thus, the rotatable and lockable fastener pins 1240 and 1241 may be retracted and locked for removal of the double-door clamping device 1200 and may be left in the retracted and locked position until the double-door clamping device 1200 is next placed on the double-doors 200 and 201 for securing the double-doors 200 and 201.

Once the holding pins 1240 and 1241 have been removed from the double-door fastener holes 260, the user may lift the handle 1285, thereby permitting the first jamb bracket 1230 and the second jamb bracket 1231 to rotate about the hinge 1280 so as to hang down such that the first base 1220 and the second base 1221 are approximately aligned. The first base 1220, the second base 1221 the first stop 1210, and the second stop 1211 may then be moved out from under the double-doors 200 and 201.

Such a double-door clamping device 1200 may be useful where, for example, the double-door 200 and 201 does not include panic hardware rods going from the double-doors 200 and 201 into the floor from the secured side of the double-door 200 and 201.

While the present invention has been disclosed with reference to certain embodiments, numerous modifications, alterations, and changes to the described embodiments are possible without departing from the scope of the present invention, as defined in the appended claims. Accordingly, it is intended that the present invention not be limited to the described embodiments, but that it have the full scope defined by the language of the following claims, and equivalents thereof.

What is claimed is:

1. A double-door clamping device comprising:

a first jamb bracket having a first end and a second end;

a second jamb bracket having a first end and a second end;

a hinge having an axis and rotatably attaching the first end of the first jamb bracket to the first end of the second jamb bracket;

a handle attached coaxially with the hinge to at least one of the first jamb bracket, the second jamb bracket, and the hinge;

a first base extending from the second end of the first jamb bracket;

a second base extending from the second end of the second jamb bracket;

a first stop attached to the first base; and a second stop attached to the second base such that the first stop and second stop can be disposed under a door when the door clamping device is lifted by the handle with the first iamb bracket and second iamb bracket hanging in a folded configuration with the first base and the second base nearly aligned, and the first stop can be disposed along the outer surface of a first door in a set of double-doors and the second stop can be disposed along the outer surface of a second door in a set of double-doors when the handle is moved downward toward a floor, thereby clamping the double-doors.

2. The door clamping device of claim 1, wherein the first jamb bracket and the second jamb bracket each have a handle side and a door side; and the first base extends from the door side of the second end of the first jamb bracket in a direction substantially parallel to the axis of the hinge;

the second base extends from the door side of the second end of the second jamb bracket in a direction substantially parallel to the axis of the hinge;

the first stop extends from the end of the first base opposite the first iamb bracket in a direction substantially perpendicular to the axis of the hinge; and the second stop extends from the end of the second base opposite the first iamb bracket in a direction substantially perpendicular to the axis of the hinge.

3. The door clamping device of claim 1, wherein the first jamb bracket includes a fastener orifice through which a pin may extend.

4. The door clamping device of claim 3, wherein the second jamb bracket includes a fastener orifice through which a pin may extend.

5. A method of installing a double-door clamping device having:

a first jamb bracket having a first end and a second end;

a second jamb bracket having a first end and a second end;

a hinge having an axis and rotatably attaching to the first end of the first jamb bracket and the first end of the second jamb bracket;

a handle attached coaxially with the hinge to at least one of the first jamb bracket, the second jamb bracket, and the hinge;

a first base extending from the second end of the first jamb bracket;

a second base extending from the second end of the second jamb bracket;

a first stop attached to the first base; and a second stop attached to the second base;

the method comprising:

lifting the door clamping device by the handle such that the first jamb bracket and second jamb bracket hang in a folded configuration with the first base and the second base nearly aligned;

holding the door clamping device adjacent closed double-doors;

sliding the first stop, the second stop, the first base, and the second base under the double-doors; and moving the handle downward toward a floor.

6. The method of installing a double-door clamping device of claim 5, wherein the first stop and the second stop extend beyond outer surfaces of the double-doors when the first stop and the second stop are slid under the double-doors.

7. The method of installing a double-door clamping device of claim 5, wherein moving the handle downward toward a floor causes the first jamb bracket and the second jamb bracket to rotate about the hinge such that the first jamb bracket and the second jamb bracket extend out to opposite sides of the hinge along the floor and the first stop and the second stop extend up along outer surfaces of the double-doors.

8. The method of installing a double-door clamping device of claim 5, further comprising securing the door clamping device to the double-doors by placing at least one holding pin through a fastener orifice formed in the door clamping device and into a fastener hole formed in the double-doors.

9. The method of installing a double-door clamping device of claim 5, further comprising securing the door clamping device to the double-doors by placing a first holding pin through a fastener orifice formed in the first jamb bracket and into a fastener hole formed in a first of the double-doors and placing a second holding pin through a fastener orifice formed in the second jamb bracket and into a fastener hole formed in a second of the double-doors.

10. The method of installing a door clamping device of claim 9, wherein the first and second holding pins are spring-biased plunger type pins.

11. A method of removing a double-door clamping device having:

a first jamb bracket having a first end and a second end;

a second jamb bracket having a first end and a second end;

a hinge having an axis and rotatably attaching to the first end of the first jamb bracket and the first end of the second jamb bracket;

a handle attached coaxially with the hinge to at least one of the first jamb bracket, the second jamb bracket, and the hinge;

a first base extending from the second end of the first jamb bracket;

a second base extending from the second end of the second jamb bracket;

a first stop attached to the first base; and a second stop attached to the second base;

the method comprising:

lifting the handle of the door clamping device, thereby permitting the first jamb bracket and the second jamb bracket to rotate about the hinge so as to hang down such that the first base and the second base are approximately aligned; and moving the first base, the second base, the first stop, and the second stop may out from under the double-doors.

12. The method of removing a double-door clamping device of claim 11, further comprising removing a first holding pin extending through the first jamb bracket into a first fastener hole formed in a first of the double-doors from the first fastener hole and removing a second holding pin extending through the second jamb bracket into a second fastener hole formed in a second of the double-doors from the second fastener hole.

* * * * *